US005430266A

United States Patent [19]

Austin, Jr. et al.

[11] Patent Number: 5,430,266

[45] Date of Patent: Jul. 4, 1995

[54] CONTROL PANEL WITH SEALED SWITCH KEYPAD

[75] Inventors: George K. Austin, Jr., Newberg; Robert E. Holden, Beaverton; Ronald A. Rolleston, II, McMinnville; Robert L. Sickler, Aloha, all of Oreg.

[73] Assignee: A-Dec, Inc., Newberg, Oreg.

[21] Appl. No.: 298,354

[22] Filed: Aug. 29, 1994

Related U.S. Application Data

[63] Continuation of Ser. No. 13,001, Feb. 3, 1993, abandoned.

[51] Int. Cl.[6] ..... H01H 9/04

[52] U.S. Cl. ..... 200/302.1; 200/333; 264/261; 264/273; 174/52.3

[58] Field of Search ..... 200/512, 517, 302.1, 200/302.2, 302.3, 333, 345, 5 A; 277/12, 227, 228; 264/261, 263, 273; 174/52.3

[56] References Cited

U.S. PATENT DOCUMENTS

| | | | |
|---|---|---|---|
| 3,062,932 | 11/1962 | Korsgren et al. | 200/302.2 X |
| 3,743,797 | 7/1973 | Hoffman | 200/5 R |
| 3,932,721 | 1/1976 | Crowell et al. | 200/302.2 |
| 4,289,940 | 9/1981 | Sado et al. | 200/5 A |
| 4,312,116 | 1/1982 | Moses et al. | 174/52.3 X |
| 4,375,018 | 2/1983 | Petersen | 200/5 A |
| 4,524,249 | 6/1985 | Farrell | 200/5 A |
| 4,623,768 | 11/1986 | Gnant . | |
| 4,655,505 | 4/1987 | Kashiwamura et al. | 297/284 |
| 4,684,767 | 8/1987 | Phalen | 200/5 A |
| 4,810,831 | 3/1989 | Heidel | 174/52.3 |
| 4,892,981 | 1/1990 | Soloway et al. | 200/5 R |
| 5,181,603 | 1/1993 | Mori et al. | 200/302.1 |
| 5,194,694 | 3/1993 | Hendel et al. | 264/261 X |

FOREIGN PATENT DOCUMENTS

| | | |
|---|---|---|
| 0404155 | 12/1990 | European Pat. Off. . |
| 9012155 | 10/1990 | Germany . |
| 2093274 | 8/1982 | United Kingdom . |
| 2248343 | 1/1992 | United Kingdom . |

OTHER PUBLICATIONS

Siemen's 27-page catalog, cover and pp. 1-7, 10, and 17-26, Feb. 1991.

Tecnodent two-page brochure, circa Jan. 1991.

Planmeca Oy seven-page "PM 2002 CC" brochure, cover and pp. 5-6, circa Jan. 1989.

Anthos "Teseo" six-page brochure, circa Jan. 1992.

KaVo "Systematica 1060" four-page French language brochure, circa Jan. 1991.

J. Morita Corporation "Surpass" 21-page Japanese language brochure, cover and pp. 6-18, circa Jan. 1991.

Signo "Grand" 19-page Japanese language brochure, cover and pp. 10-12, circa Jan. 1991.

KaVo "Estetica 1042" 16-page German language brochure, circa Jan. 1991.

Takara Belmont 50-page Japanese language dental equipment brochure, cover and pp. 8-18, circa Jan. 1991.

*Primary Examiner*—Henry J. Recla
*Assistant Examiner*—David J. Walczak
*Attorney, Agent, or Firm*—Klarquist Sparkman Campbell Leigh & Whinston

[57] ABSTRACT

The front panel of a control panel is provided with a recess for receiving a keypad. The recess is larger than the keypad to define a channel between the edges of the keypad and the sides of the recess. A sealant fills the channel to provide a smooth transition between the front panel and the keypad that protects the edges of the keypad and prevents the entry of moisture and debris into the channel. The control panel can be assembled by fixing the keypad within the recess, placing a temporary barrier over the top surface of the channel, and introducing the sealant into the channel. The sealant can be introduced through one or more ports in either the front panel or the temporary barrier. The temporary barrier is removed when the sealant hardens within the channel.

15 Claims, 2 Drawing Sheets

CONTROL PANEL WITH SEALED SWITCH KEYPAD

This application is a continuation of application Ser. No. 08/013,001, filed on Feb. 3, 1993 now abandoned.

BACKGROUND OF THE INVENTION

1. Field of the Invention

The present invention relates to control panels, and more particularly, to control panels with switch keypads.

2. Description of Related Art

Many devices are provided with control panels to allow a user to input information or control the operation of the device. Control panels typically have a keypad with one or more mechanical keys, or switches, which can be selectively actuated. Actuation of a switch generally completes, or breaks, an electrical circuit to thereby provide a signal to the device.

In use, such control panels are often exposed to dirt, moisture, and the like. If these materials are allowed to enter the control panel, the control panel may be seriously damaged. For example, dirt can build up around a switch causing it to jam or stick. Similarly moisture can short circuit the electrical connections within the control panel. In either case, the control panel may fail to function properly. Thus, it is desirable to prevent the entry of moisture, dirt, or other harmful materials into the control panel.

Furthermore, many control panels, such as those used for medical or dental instruments, must be maintained in a clean and sanitary condition. Such control panels must be able to withstand the solvents and disinfectants used to clean them. Moreover, such control panels must preferably be free of cracks, crevices, or corners where dirt can collect and bacteria can multiply.

Many control panels incorporate keypads having one or more membrane switches. There are a wide variety of different types of membrane switches. However, a typical membrane switch has a continuous membrane outer covering. One or more switch locations are embossed or printed on the outer covering. At each switch location an electrical contact is positioned on the underside of the outer covering. A spacer and a substrate are positioned beneath the outer covering. The spacer, which serves to separate the outer covering from the substrate, has an aperture at each switch location. In this manner, when a user presses on a switch location, the outer covering deforms allowing the electrical contact on its underside to be brought into contact with a corresponding electrical contact provided on the substrate. This completes an electrical circuit to provide the appropriate signal to the device.

The outer covering, or membrane, is typically made of plastic or the like and is a single continuous sheet. As a result, it is well suited to prevent the entry of moisture and dirt around the switches. Moreover, the outer covering is typically generally smooth and has no cracks and crevices around the switches to collect dirt and bacteria.

However, the edges of a membrane switch keypad are typically of a layered construction. The outer covering forms a layer, the spacer forms a layer, and the substrate forms a layer. When the edges of a membrane switch keypad are exposed to moisture, the moisture can enter and travel between the layers to the electrical contacts. Similarly, dirt and bacteria can become trapped around the edge of the keypad and work in between or under the layers of the keypad where it can collect and multiply. These problems are exacerbated over time as the adhesive between the layers may degrade and constant use may cause the edges of the membrane switch to delaminate.

In an attempt to overcome these problems, many control panels are constructed with a frame-like member over the perimeter of the membrane switch keypad. In this configuration, the edges of the membrane switch keypad are secured beneath the frame and are not directly exposed to wear, moisture, and bacteria. However, the joint between the frame and the outer covering creates a crevice which may collect moisture, debris and bacteria. The moisture and bacteria can work deep into the crevice between the frame and the outer membrane where they are sheltered from both detection and removal.

In another attempt to alleviate the existing shortcomings of control panels with membrane switches, the outer covering of the membranes witch is made larger than the remaining layers to overlap and cover the lower layers when the keypad is attached to the control panel. In this manner, the layered edges of the membrane switch are shielded from direct exposure to the elements by the overlapping outer covering. The lower surface of the outer cover is provided with an adhesive which can serve to attach the membrane switch to the control panel and, at the same time, form a protective seal to limit the moisture, debris and bacteria which reach the covered edges of the membrane switch.

However, in this configuration, a bump or discontinuity is created between the edge of the outer layer and the control panel. This bump tends to collect moisture, debris and bacteria. Moreover, in use, objects may catch or snag on the bump causing it to separate from the control panel and allowing moisture and debris to enter under the outer covering. These problems are particularly acute for medical or dental instruments where the control panel is required to be thoroughly scrubbed, often with disinfectants or solvents, on a regular basis. Such scrubbing tends to accelerate separation of the outer covering from the control panel and hasten entry of moisture, debris and bacteria under the membrane switch.

SUMMARY OF THE INVENTION

Accordingly, it is an object of the present invention to provide a control panel having switches that effectively prevent the ingress of moisture, debris, and bacteria into the switching elements.

It is a further object of the invention to provide a control panel that is durable, easy to clean, and easy to maintain.

A control panel in accordance with one aspect of the present invention has a front panel with a recess. A keypad is positioned in the recess. The recess is larger than the keypad such that a channel is formed between the sides of the recess and the edges of the keypad. The channel is filled with a sealant which forms a smooth transition between the front panel and the keypad and acts as a barrier to prevent moisture and the like from entering the channel and contacting the edges of the keypad.

In one aspect of the invention, at least one port is formed in the front panel extending from the channel to the rear side of the front panel to allow the introduction of the sealant into the channel.

In another aspect of the invention, the control panel is assembled by fixing the keypad within the recess. Then, a temporary barrier is placed over the top surface of the channel to define a smooth transition surface between the front panel and the keypad. A liquid sealant is introduced into the covered channel. The sealant can be introduced into the channel either through a port in the temporary barrier or a port in the front panel. The temporary barrier is removed when the sealant hardens within the channel.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
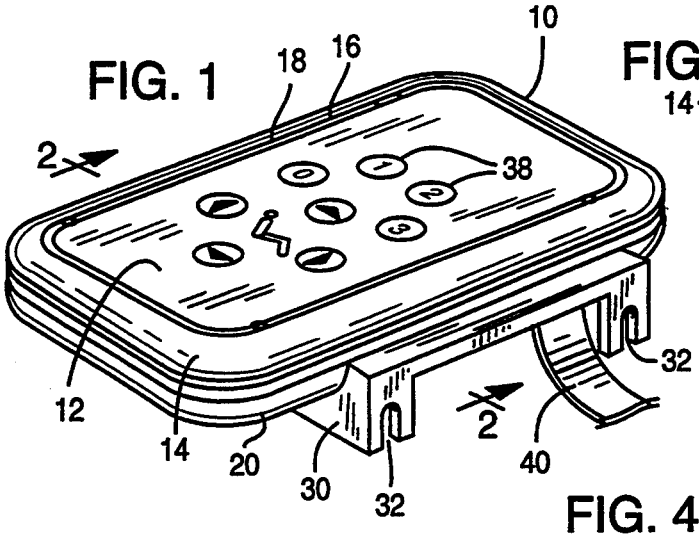
FIG. 1 is perspective view of a control panel in accordance with a preferred embodiment of the present invention.

A control panel in accordance with a preferred embodiment of the present invention is illustrated in FIG. 1 as reference numeral 10. The control panel 10 has a membrane keypad 12 fixed to the front panel 14. A channel 16 surrounding the keypad 12 is filled with sealant 18 to form smooth transition between the front panel 14 and the keypad 12. The smooth transition formed by the sealant 18 allows the control panel 10 to be easily wiped clean without snagging or catching and eliminates any cracks, crevices, or corners where dirt and bacteria can collect. In addition, the sealant 18 serves as a barrier to prevent moisture and debris from entering the keypad 12.

Figure 2:
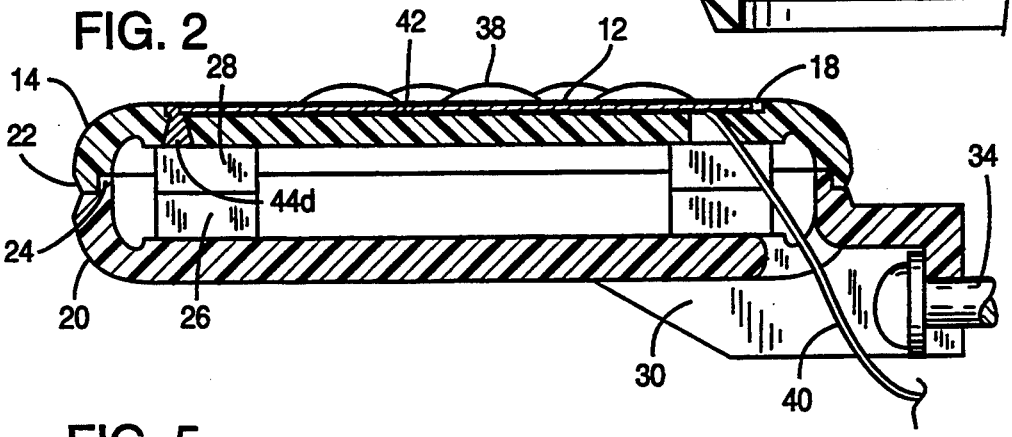
FIG. 2 is a cross sectional view taken along line 2—2 in FIG. 1.

As best seen in FIG. 2, the control panel 10 is formed of a front panel 14 and a rear panel 20. The front panel 14 is formed with a flange 22 formed about its perimeter. A mating flange 24 is formed about the perimeter of the rear panel 20. The mating flange 24 registers with flange 26 when the front panel 14 is attached to the rear panel 20. In this manner, solid mating engagement between the front panel 14 and the rear panel 20 is achieved and foreign matter is prevented from entering the control panel 10.

The front panel 14 is attached to the rear panel 20 by means of four screws (not shown), each of which passes through a boss 26 formed in the rear panel and engages a boss 28 formed in the front panel. The rear panel 20 is also provided with a mounting lug 30. The mounting lug 30 extends from one side of the rear panel 20 and is provided with apertures 34 for receiving screws 36 to mount the control panel 10 in a convenient position on or near the device being controlled.

The illustrated control panel 10 is intended to control the position of a dental chair (not shown). Accordingly, it can be mounted within easy reach of the dentist adjacent the dental instrument control panel. Of course, it should be recognized that a control panel 10 in accordance with the present invention may be used to control any number of different devices and that the present invention is not limited to the embodiment described here in the context of a control panel for a dental chair.

Figure 7:
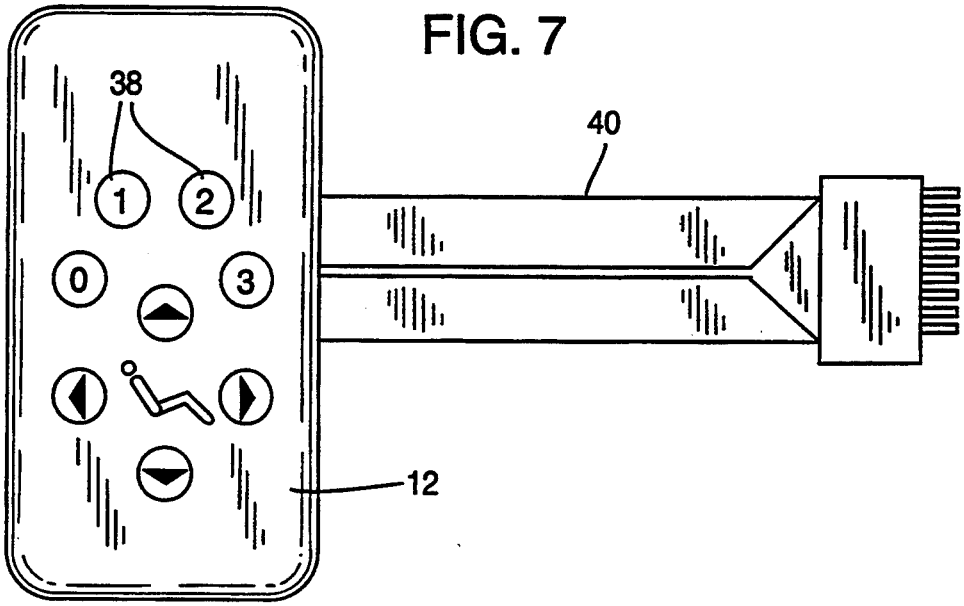
FIG. 7 is a top view of the membrane keypad.
Figure 8:
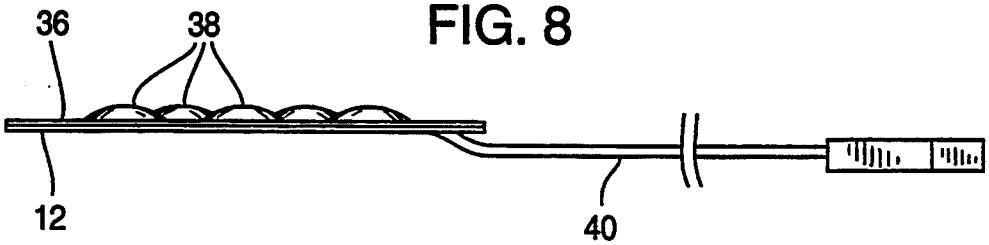
FIG. 8 is a side view of the membrane keypad.

As seen in FIGS. 2, 7 and 8, the illustrated keypad 12 is a membrane keypad. By membrane keypad it is meant that the keypad 12 is covered by a continuous sheet of material. The illustrated keypad 12 is generally planar and has a plurality of raised switches 38 formed on its front surface 36. As shown best in FIG. 7 indicia can be printed, or otherwise provided, on the front surface 36 to identify the function of each switch 38. The illustrated keypad 12 is provided with a flat connector cable 40 to electrically couple the keypad 12 to the device being controlled.

In the illustrated keypad, each switch 38 is a raised dome. This helps to provide a tactile indication allowing a user to detect when a switch 38 is actuated. However, in alternative embodiments flat switches, or some other type of switch, could also be used. Similarly, it should be recognized that a wide variety of types of keypads can be incorporated into a control panel in accordance with the present invention. Thus, the keypad need not be of the type illustrated.

Figure 5:
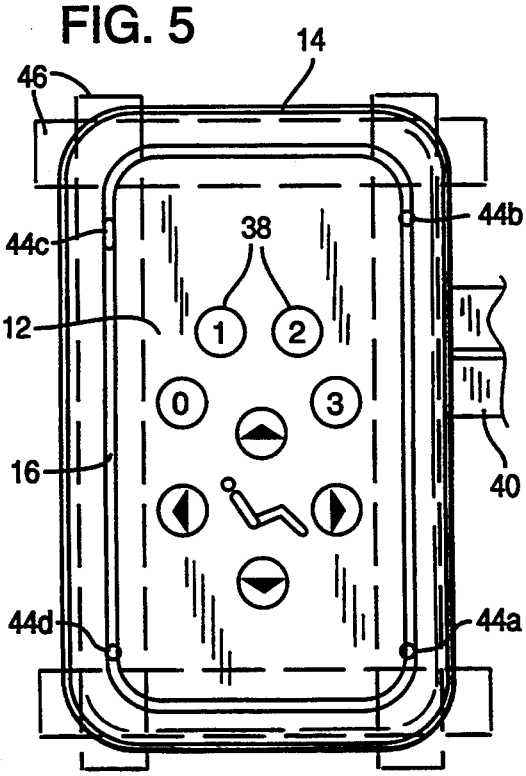
FIG. 5 is a top view of the control panel of FIG. 1 showing the temporary barrier.

The front panel 14 is provided with a recess 42. As seen in FIGS. 2 and 5, the keypad 12 is positioned within the recess 42. The recess 42 has a depth approximately equal to the thickness of the keypad 12 and has a generally planar bottom. In this manner, the top surface 36 of the keypad 12 is approximately even with the top surface of the front panel 14 when the keypad 12 is positioned within the recess. In the illustrated embodiment the rear surface of the keypad 12 is provided with an adhesive for fixing the keypad within the recess 42.

As best seen in FIGS. 2 and 5, the recess 42 has the same general shape as the keypad 12 but is larger. The keypad 12 is generally centered within the recess 42 such that a channel 16 is formed between the edges of the keypad 12 and the sides of the recess 42. In the illustrated embodiment, the channel 16 has a generally rectangular cross section and is approximately as deep as the thickness of the keypad and is approximately as wide as the thickness of the keypad. However, in other embodiments, the shape and dimensions of the channel can vary greatly.

As illustrated in FIGS. 1 and 2, the channel 16 is filled with a sealant 18. The sealant 18 forms a smooth transition from the front surface of the front panel 14 to the front surface of the keypad 12. This smooth transition has no crevices or corners where moisture, debris, and bacteria can collect. The smooth transition also serves to prevent the edges of the keypad 12 from catching or snagging. This helps to prevent wear and damage to the keypad 12 and helps to keep the keypad 12 intact and in place. The sealant 18 also serves as a barrier to prevent moisture and debris from entering through the sides of the keypad 12 and causing damage.

Figure 6:
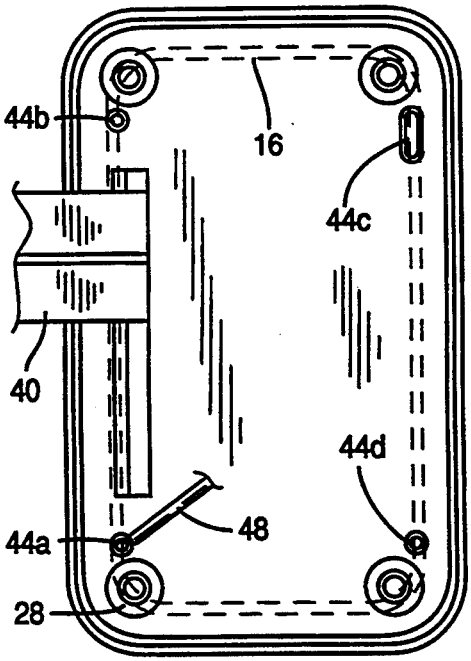
FIG. 6 is a bottom view of the front panel of the control panel of FIG. 1 showing the introduction of the sealant.

In the illustrated embodiment, four ports 44*a–d*, seen best in FIGS. 5 and 6, extend from the channel 16 to the rear surface of the front panel 14. The ports 44*a–d* allow the sealant to be introduced into the channel from the rear of the front panel 14. Although four ports are shown in the illustrated embodiment, a different number may be desirable in other embodiments.

Figure 3:
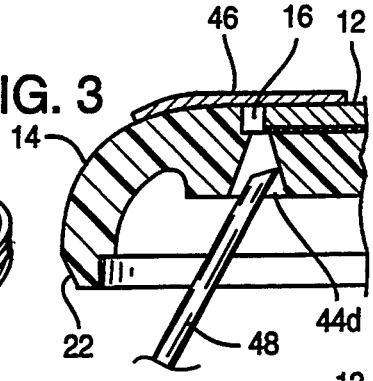
FIG. 3 is a partial cross sectional view of the front panel prior to the introduction of the sealant and showing the temporary barrier and partially showing the instrument for introducing the sealant.
Figure 4:
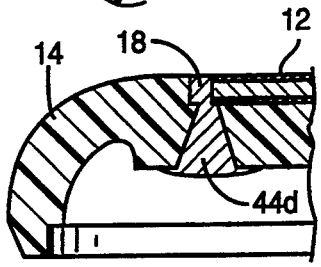
FIG. 4 is a view of the front panel as shown in FIG. 3 after the introduction of the sealant and removal of the temporary barrier.

In a preferred method of making the illustrated control panel 10, the keypad 12 is positioned within the recess 42. Preferably, the keypad is generally centered within the recess so that the dimensions of the channel are substantially uniform along its length. Then as illustrated in FIGS. 3 and 5, a temporary barrier 46 is placed over the top of the channel 16. In the illustrated embodiment, the temporary barrier 46 is mylar tape with an acrylic adhesive. However, in other embodiments, the temporary barrier could be virtually any suitable material and could be held in place with clamps or the like. The tape is placed over the top of the channel 16 prior to introducing the sealant in order to define an upper boundary for the channel that has a smooth, continuous transition from the front panel 14 to the keypad 12.

With the channel 16 covered with the temporary barrier 46 the sealant 18 can be introduced into the channel 16. In the illustrated embodiment, the front panel is provided with four ports 44*a–d* which extend from the channel to the rear of the front panel. The sealant 18 can be introduced into the enclosed channel 16 through these ports. In alternative embodiments, however, one or more ports can be provided in the temporary barrier to allow the sealant to be introduced into the channel.

In the illustrated embodiment, the ports 44*a–d* are generally uniformly separated along the length of the channel. It has been found desirable for one of the ports 44*c* to be slightly larger than the others to allow for the escape of air from the channel as the sealant is introduced. Preferably, the sealant 18 is introduced by injecting it through the ports 44*a–d* with a hypodermic needle 48 or the like.

It has been found that the sealant 18 can be injected into the channel in a smooth, bubble-free manner by starting the injection at the port 44*a* opposite from the enlarged port 44*c*. As the sealant is injected into port 44*c* it fills the enclosed channel and follows the channel to ports 44*b* and 44*d*. The displaced air can leave the enclosed channel through ports 44*b–d*. When the sealant fills the channel between ports 44*a* and 44*b*, additional sealant can be injected through port 44*b* until the sealant fills the channel to port 44*c*. Similarly, when the sealant injected through port 44*a* fills the channel between ports 44*a* and 44*d*, additional sealant can be injected through port 44*d* to fill the channel between ports 44*d* and 44*c*. In this manner, enlarged port 44*c* provides a vent through which the air within the channel can exit to allow the sealant to fill the channel in a smooth, bubble-free manner.

In the illustrated embodiment, the sealant is introduced into the channel 16 through the ports 44*a–d* formed in front panel 14. However, in alternative embodiments it may be desirable to inject the sealant into the channel 16 through one or more ports formed in the temporary barrier 46. Alternatively, ports in both the temporary barrier and the front panel may be used in combination to allow the smooth, even introduction of sealant into the channel and the efficient exit of air from the channel.

Preferably, in the illustrated embodiment, the sealant is a low viscosity epoxy resin which is selected to cure at room temperature to avoid damage to the keypad. In the illustrated embodiment, the channel is about 0.030 inches wide and 0.030 inches deep. The ports 44*a–b* and *d* have an opening at the channel that is approximately 0.030 inches in diameter and taper outward to a diameter of about 0.093 inches at the rear surface of the front panel. For these dimensions, it has been found that an epoxy with a viscosity that allows it to enter a 0.005-inch crevice is satisfactory. However, the type of sealant may vary in different types of control panels. Different types of epoxies, resins or other materials may all be suitable depending on the type keypad, the material from which the front panel is constructed, and any particular environmental conditions to which the control panel will be exposed. The epoxy in the illustrated embodiment is also colored to contribute to an aesthetically pleasing appearance for the control pad.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

We claim:

1. A control panel comprising:

a front panel having a recess and a peripheral part that surrounds the recess;

a keypad positioned within the recess, the keypad having a front surface and being smaller than the recess to define a channel between the keypad and the peripheral part; and sealant filling the channel to define a boundary surface of the sealant that is substantially coplanar with the front surface, thereby to form a smooth transition between the front surface and the peripheral part.

2. The control panel of claim 1 in which the front panel is provided with a back side and with at least one port extending between the channel and the back side of the front panel to allow the introduction of the sealant into the channel.

3. The control panel of claim 2 in which the sealant is epoxy.

4. A control panel comprising:

a keypad having a front surface and at least one switch formed on the front surface;

a front panel having a recess for receiving the keypad, the recess being larger than the keypad to define a channel around the keypad; and sealant filling the channel to form a smooth transition between the front panel and the keypad, the front panel having a back and at least one port extending from the channel to the back of the front panel to allow the sealant to be introduced into the channel.

5. The control panel of claim 4 in which the switch is a membrane switch.

6. The control panel of claim 4 in which the keypad has a thickness and in which the recess has a depth that is greater than or approximately equal to the thickness of the keypad.

7. The control panel of claim 4 in which the keypad has a thickness and in which the channel has a width that is greater than or approximately equal to the thickness of the keypad.

8. The control panel of claim 4 in which the sealant is epoxy.

9. The control panel of claim 4 in which the sealant provides a barrier to prevent the entry of moisture and debris into the channel.

10. The control panel of claim 4 in which the sealant forms a smooth transition surface from the front panel to the keypad.

11. A method of making a control panel having a keypad attached to a front panel, comprising the steps of:

forming a recess in the front panel, said recess being larger than the keypad;

placing the keypad within the recess to define a channel around said keypad;

introducing a liquid sealant into the channel; and hardening the sealant.

12. The method of claim 11 in which the sealant is introduced into the channel through a port extending from the channel through the front panel.

13. The method of claim 11 further comprising the steps of:

covering the channel with a temporary barrier prior to introducing the sealant into the channel; and removing the temporary barrier after hardening the sealant.

14. The method of claim 13 in which the sealant is introduced into the channel through at least one port extending from the channel through the front panel.

15. The method of claim 13 in which the sealant is introduced into the channel through at least one port in the temporary barrier.

* * * * *